US005593937A

United States Patent [19]

Saito et al.

[11] Patent Number: 5,593,937

[45] Date of Patent: Jan. 14, 1997

[54] IMAGE-BEARING MEMBER AND METHOD FOR RECYCLING THE SAME

[75] Inventors: Tadashi Saito; Kiyoshi Tanikawa, both of Yokohama; Eiichi Kawamura; Toshiyuki Kawanishi, both of Numazu, all of Japan

[73] Assignee: Ricoh Company, Ltd., Tokyo, Japan

[21] Appl. No.: 278,844

[22] Filed: Jul. 22, 1994

[30] Foreign Application Priority Data

Jul. 22, 1993 [JP] Japan ..... 5-201886

[51] Int. Cl.[6] ..... B41M 5/128

[52] U.S. Cl. ..... 503/201; 15/77; 156/230; 156/234; 162/4; 162/56; 427/140; 427/141; 427/264; 427/270; 427/271

[58] Field of Search ..... 503/201; 428/195, 428/913, 914, 211, 484, 488.1, 488.4, 537.5; 427/140, 141, 264, 270, 271; 156/230, 234; 15/77; 162/4, 56

[56] References Cited

U.S. PATENT DOCUMENTS 5,491,121 2/1996 Kuchta ..... 503/200

*Primary Examiner*—B. Hamilton Hess

*Attorney, Agent, or Firm*—Oblon, Spivak, McClelland, Maier & Neustadt, P.C.

[57] ABSTRACT

An image-bearing member for supporting thereon images formed by a thermofusible or heat-softening ink containing a dye coloring component, at least part of the image-bearing member having a paper layer which contains cellulose fibers and a discoloring agent capable of discoloring the dye coloring component of the thermofusible or heat-softening ink. In addition, a method for recycling the above-mentioned image-bearing member is also disclosed.

10 Claims, No Drawings

IMAGE-BEARING MEMBER AND METHOD FOR RECYCLING THE SAME

BACKGROUND OF THE INVENTION

1. Field of the Invention

The present invention relates to an image-bearing member comprising a support material, at least part of which comprises a paper layer capable of bearing images formed by a thermofusible or a heat-softening ink, which image-bearing member can be recycled, and a method for recycling the above-mentioned image-bearing member.

2. Discussion of Background

Because of recent rapid development of office automation, a large quantity of papers for printers and copying machines has been used and consumed. This has caused the problems of the environmental disruption of the earth due to deforestation.

Conventionally, in order to recycle papers of this kind, printed ink is removed from the paper, and the ink-free paper is crushed and paper is made therefrom again. This has been an only method of recycling this kind of paper materials.

However, recently a method for recycling used copy papers by cleaning printed images off the surface of the copy paper has been developed, and examples of such a recycling method have been described, for instance, in the following references:

(1) Japanese Laid-Open Patent Application 4-67043:

There is proposed a sheet-shaped image-bearing member for supporting images thereon. This image-bearing member can be reused by treating one side of the sheet to make releasable, and this kind of sheet is distinguished from a plain copy paper by marking the sheet. However, this kind of sheet has the following drawbacks:

(a) This surface-treated image-bearing sheet is a special paper, so that it is not easy to apply this sheet to the commonly used copying machines and printers.

(b) Therefore, it is difficult to mix this surface-treated papers and plain copy papers and use them in the same copying machine.

(c) In view of the significance of recycling resources, duplex copies which bear images on both sides thereof are useful and will become very popular in the future. Under such circumstances, however, the method for recycling copy papers by applying a releasing agent to one side of a copy paper is neither effective nor useful.

(d) Since a releasing agent is applied to a support sheet, the image fixing performance thereof is poor as a matter of course.

(2) Japanese Laid-Open Patent Applications 1-101576 and 1-101577:

A toner-image-bearing copy paper is immersed into an organic solvent in which a resin contained in the toner images formed on the copy paper is soluble, and is then subjected to an ultrasonic wave treatment, thereby removing toner images from the copy paper. This method, however, has the shortcomings that organic solvents used cause air pollution problems and are ignitable and toxic, accordingly not suitable for office or home use.

(3) Japanese Laid-Open Patent Application 1-297294:

In this application, plastics, metals, papers into which liquids hardly penetrate, and ceramics are employed as the support materials for a toner-image-bearing member. Toner images formed on the support are heated through a thermofusible releasing member, whereby toner images are peeled from the support and the support is cleaned. In this method, however, a special erasable paper subjected to releasing treatment has to be used. Therefore, this method has the shortcoming that it cannot be applied to a large quantity of copy paper and printing paper now in general use.

Furthermore, the applicants of the present invention have proposed a method for recycling the image-bearing member comprising a support material, at least part of the support material comprising a paper layer which bears images formed by a thermofusible or heat-softening ink comprising a coloring component. This recycling method comprises the steps of bringing the image bearing side of the image-bearing member into contact with an aqueous solution of at least one component selected from the group consisting of a surfactant and a water-soluble polymer; and causing an image release member to adhere to the paper layer with the application of heat and/or pressure thereto; and peeling the images away from the paper layer.

The above-mentioned image-bearing member can be recycled and again subjected to copying and printing operations, with high quality of the material being maintained. However, the thermofusible or heat-softening ink used for the image formation may contain a coloring component such as a water-soluble dye. In this case, such a dye coloring component tends to permeate through the support material and dye the same in the course of the peeling process, thereby forming residual dye images in the support material. The value of the image-bearing member as an article of commerce is impaired once dyed with the dye coloring component.

SUMMARY OF THE INVENTION

It is therefore a first object of the present invention is to provide an image-bearing member for supporting images thereon, which can be recycled for the copying and printing by cleaning PPC copied images or PPC printing images off the image-bearing member.

A second object of this invention is to provide a method for recycling the image-bearing member by not only cleaning the copied images and printing images off the previously mentioned special erasable paper, but also removing PPC copied images and PPC printing images from such PPC papers.

The first object of this invention can be achieved by an image-bearing member for supporting thereon images formed by a thermofusible or heat-softening ink comprising a dye coloring component, at least part of the image-bearing member comprising a paper layer which comprises cellulose fibers and a discoloring agent capable of discoloring the dye coloring component of the thermofusible or heat-softening ink.

The second object of the present invention can be achieved by a method of recycling an image-bearing member comprising a support material, at least part of the support material comprising a paper layer which comprises cellulose fibers and bears images formed by a thermofusible or heat-softening ink which comprises a dye coloring component, comprising the steps of bringing the image-bearing member into contact with an aqueous solution of a discoloring agent capable of discoloring the dye coloring component of the thermofusible or heat-softening ink; and peeling the images off the paper layer by an image peeling-off member with the application of heat and/or pressure thereto.

The second object of the present invention can also be achieved by a method of recycling an image-bearing member comprising a support material, at least part of the support material comprising a paper layer which bears images formed by a thermofusible or heat-softening ink comprising a dye coloring component, and comprises cellulose fibers and a discoloring agent capable of discoloring the dye coloring component of the thermofusible or heat-softening ink, comprising the steps of bringing the image-bearing member into contact with water, or an aqueous solution of at least one component selected from the group consisting of a surfactant, a water-soluble polymer, and the discoloring agent, and peeling the images off the paper layer by an image peeling-off member with the application of heat and/or pressure thereto.

DESCRIPTION OF THE PREFERRED EMBODIMENTS

The problem that the dye coloring component contained in the thermofusible or heat-softening ink permeates through the support material of the image-bearing member and dye the same in the course of image peeling-off process can be solved by using a discoloring agent, for example, a bleaching agent which can decompose the dye coloring component in the thermofusible or heat-softening ink. Thus, the permeation of the dye coloring component through the support material can be prevented when the images are peeled from the paper layer.

An image-bearing member according to the present invention can support thereon images formed by a thermofusible or heat-softening ink comprising a dye coloring component, and at least part of the image-bearing member comprises a paper layer which comprises cellulose fibers and a discoloring agent capable of discoloring the dye coloring component of the thermofusible or heat-softening ink.

A bleaching agent capable of bleaching a coloring component contained in the thermofusible or heat-softening ink to be employed can be used as the discoloring agent.

Examples of the bleaching agent for use in the present invention are shown in Table 1:

TABLE 1

| |
|---|
| Oxidation Bleaching Agents |
| Peroxide bleaching agents |
| hydrogen peroxide |
| sodium peroxide |
| potassium peroxide |
| sodium peroxoborate |
| potassium permanganate |
| Chlorine-containing bleaching agents |
| chloride of lime |
| sodium hypochlorite |
| potassium hypochlorite |
| sodium chlorite |
| potassium chlorite |
| Reduction Bleaching Agents |
| sulfur dioxide |
| sodium bisulfite |
| potassium bisulfite |
| sodium hydrosulfite |
| sodium dithionite |
| potassium dithionite |

Furthermore, the paper layer of the image-bearing member may further comprise at least one component selected from the group consisting of a surfactant and a water-soluble polymer. More specifically, the paper layer of the image-bearing member may be impregnated with an aqueous solution of a discoloring agent such as a bleaching agent, and at least one component selected from the group consisting of a surfactant and a water-soluble polymer, and dried prior to the image formation. Thus, the images can be peeled from the paper layer more easily in the method of recycling the image-bearing member. In the present invention the discoloring agent such as the bleaching agent is contained in the paper layer of the image-bearing member, so that the formation of the residual dye images can be prevented.

As the support material for the image-bearing member, copy paper and printing paper are mainly used. It is not always necessary that the support material consist of paper in its entirety, but any support material can be used so long as at least part of the support material comprises a paper layer comprising cellulose fibers and capable of bearing images formed by a thermofusible or heat-softening ink. For instance, a composite material composed of a cellulose-fiber-containing paper layer and a plastics layer which are overlaid can be employed.

Generally when a cellulose-fiber-containing paper is made wet, its stiffness is decreased. In the case where an image-bearing member supports thereon images formed by a hydrophobic thermofusible or heat-softening ink, the adhesion between the hydrophobic ink held in the paper and the paper is extremely decreased when the image-bearing member is made wet. Therefore, the images can easily be removed from the image-bearing member without impairing the paper layer by impregnating the cellulose-fiber-containing paper layer of the image-bearing member with water, in particular, with a sufficient amount of water using a surfactant, and peeling the images from the paper layer by use of appropriate image peeling-off means. Furthermore, when the image-bearing member is also brought into contact with a water-soluble polymer for the removal of images, the images can be peeled from the paper layer more efficiently because the water-soluble polymer can serve as a member capable of peeling the images readily from the paper layer of the image-bearing member.

According to the present invention, when the cellulose-fiber-containing paper layer of the image-bearing member bears thereon images formed by a thermofusible or heat-softening ink which comprises a dye coloring component, the images can be removed from the paper layer, and the image-bearing member can be recycled by bringing the image-bearing member into contact with an aqueous solution of a discoloring agent capable of discoloring the dye coloring component of the thermofusible or heat-softening ink; and peeling the images off the paper layer by an image peeling-off member with the application of heat and/or pressure thereto.

In the above-mentioned recycling method, the aqueous solution of the discoloring agent may further comprise at least one component selected from the group consisting of a surfactant and a water-soluble polymer.

Furthermore, when images are formed using a thermofusible or heat-softening ink comprising a dye coloring component on the image-bearing member comprising a support material, at least part of the support material comprising a paper layer which comprises cellulose fibers and a discoloring agent capable of discoloring the dye coloring component of the thermofusible or heat-softening ink, the images can be removed from the paper layer, and the image-bearing member can be recycled by bringing the image-bearing member into contact with water, or an aqueous solution of at least one component selected from the group consisting of a surfactant, a water-soluble polymer, and the discoloring agent, and peeling the images off the paper layer by an image peeling-off member with the application of heat and/or pressure thereto.

The thermofusible or heat-softening ink capable of forming images on the paper layer of the image-bearing member of the present invention comprises a resin component, such as polystyrene, acrylic resin, methacrylic resin, styrene-butyl acrylate copolymer, styrene-butadiene copolymer, polyester or epoxy resin.

For wetting the paper layer of the image-bearing member which bears images formed by a thermofusible or heat-softening ink with water in a short time, the water-wettability of the image-bearing member is an important factor. Furthermore, for removing the ink images from the paper layer, it is required that a sufficient amount of water permeate into the interface between the thermofusible or heat-softening ink and the paper layer.

A surfactant is employed to cause water to permeate into the paper layer of the image-bearing member effectively.

Specific examples of such a surfactant include anionic surfactants of a fatty acid derivative type, a sulfuric ester type, a sulfonic acid type, and a phosphoric ester type; cationic surfactants such as quaternary ammonium salts, amines having an ester bonding, quaternary ammonium salts having an ether bond, heterocyclic amines, and amine derivatives; ampholytic surfactants; and nonionic surfactants.

Furthermore, in order to make easy the releasing of the thermofusible or heat-softening ink from the paper layer, a water-soluble polymer is also useful.

Representative examples of such a water-soluble polymer are shown in the following Table 2. Water-soluble polymers for use in the present invention are not limited to those shown in Table 2.

TABLE 2

- Natural polymers
  - Starch
    - Sugar cane starch
    - Potato starch
    - Tapioca starch
    - Wheat starch
    - Cone starch
  - Mannan
    - Konnyaku
  - Seaweeds
    - Glue plant
    - Agar
    - Sodium alginate (nontoxic)
  - Plant mucilage
    - Bibiscus
    - Tragacanth gum
    - Gum arabic
  - Microorganism mucilage
    - Dextran
    - Levan
  - Protein
    - Glue
    - Gelatin
    - Casein
    - Collagen TABLE 2-continued

- Semi-synthesized products
  - Cellulose
    - Viscose
    - Methyl cellulose (MC) (low toxic)
    - Ethyl cellulose (EC)
    - Hydroxyethyl cellulose (HEC)
    - Carboxymethyl cellulose (CMC) (nontoxic)
  - Starch
    - Soluble starch
    - Carboxymethyl starch (CMS)
    - Dialdehyde starch
- Synthesized products
  - Polyvinyl alcohol (poval)
  - Sodium polyacrylate
  - Polyethylene oxide
  - Isobutylene - maleic anhydride copolymer These surfactants, water-soluble polymers and bleaching agents are used as sizing agents for paper in paper-manufacturing industry. Therefore even if these surfactants, water-soluble polymers and bleaching agents are employed, they do not impair the surface of paper, but improve the quality of the surface of paper.

The concentration of an aqueous solution of a bleaching agent, and a surfactant and/or water-soluble polymer is preferably in the range of 0.1 to 20 wt.%, more preferably in the range of 0.5 to 10 wt.%. When the concentration is excessively high, the recycled paper tends to become hard or adhesive because of the absorption of water in air.

According to the method of recycling the image-bearing member of the present invention, an image peeling-off member is used to remove the images from the paper layer. Because the image peeling-off member is adhesive to the images formed on the paper layer, the images are peeled from the paper layer and transferred to the image peeling-off member by bringing the image peeling-off member into contact with the images with the application of heat and/or pressure thereto, and releasing the image peeling-off member therefrom.

Examples of a material for use in such an image peeling-off member include organic high-molecular materials, particularly, a high-molecular material with substantially the same SP value as that of a resin component contained in the thermofusible or heat-softening ink; and inorganic materials such as a metallic material with high surface activity energy, a material deposited with the above-mentioned metallic material, and ceramics.

As the organic high-molecular materials for use in the image peeling-off member for use in the present invention, there can be employed the above-mentioned water-soluble polymers, the resin components contained in the thermofusible or heat-softening ink, or resin components contained in adhesive agents. When the resin is used for the image peeling-off member, any resin which may be water-soluble or not can be used so long as it has adhesion to the images.

Specific examples of the resin components contained in the adhesive agents are protein-based resins such as glue, gelatin, albumin and casein; carbohydrate-based resins such as starch, cellulose, and complex poly-saccharide including gum arabic and gum tragacanth; thermoplastic resins such as vinyl acetate polymer and copolymer, acrylic copolymer, ethylenic copolymer, polyamide, polyester, and polyurethane; and rubbers such as polychloroprene rubber, nitrile rubber, reclaimed rubber, SBR rubber, and natural rubber.

The above-mentioned resins for the image peeling-off member can be employed by providing them on the surface of a support such as a roller, sheet, belt or a tape. As such an image peeling-off member, for example, a rubber-based or acrylic pressure sensitive adhesive agent may be provided on the surface of the support of cellophane tape, adhesive craft-paper tape, polyvinyl chloride tape, acetate tape, or filament-reinforced tape. In this case, it is preferable that the surface of the support be porous or comprise a porous material thereon. Alternatively, the surface of the support may be surface-treated to have surface roughness.

For the image peeling-off member, the above-mentioned resins may be formed into a roller, a sheet, a belt or a tape.

The features of this invention will become apparent in the course of the following description of exemplary embodiments, which are given for illustration of the invention and not intended to be limiting thereof.

EXAMPLE 1

A fresh copy paper of A4 size for use with a plain paper copying machine was immersed into an aqueous solution of a water-soluble starch in an amount of 1% and a commercially available bleaching agent "Color Bright" (Trademark), made by Lion Corporation in an amount of 1%, and then dried by an appropriate drying method, so that a copy paper capable of being repeatedly used for image formation was obtained.

Toner images were formed on the above prepared copy paper using a commercially available plain paper copying machine (Trademark "IMAGIO 320 FP1" made by Ricoh Company, Ltd.).

The thus prepared toner image bearing copy paper was immersed into an aqueous solution of a water-soluble starch in an amount of 1% and the commercially available bleaching agent "Color Bright" (Trademark), made by Lion Corporation in an amount of 1%. Then, a heated rubber roller was brought into pressure contact with the toner image bearing side of the copy paper. When the rubber roller was released from the image-bearing copy paper, the toner images were thoroughly transferred to the rubber roller.

The copy paper which passed over the rubber roller became a plain paper free from toner images thereon. When the images were peeled from the copy paper by use of the rubber roller, the cellulose fibers have scarcely been removed from the paper layer of the copy paper. Therefore, the surface profile of the copy paper after the above-mentioned image peeling operation was similar to that of a fresh copy paper. There was never seen any residual dye image which was formed on the support material by the permeation of a small amount of the dye contained in the toner through the support material.

This copy paper was dried, and toner images were formed once again on the copy paper by use of the above-mentioned copying machine. The result was that clear toner images were formed on the copy paper exactly in the same state as first formed.

The above operation was repeated 10 times. Toner images with the same quality were formed on the copy paper throughout the above ten operations.

EXAMPLE 2

A fresh copy paper of A4 size for use with a plain paper copying machine was immersed into an aqueous solution of carboxymethyl cellulose in an amount of 2% and a commercially available chlorine-containing bleaching agent "Heiter" (Trademark), made by Kao Corporation in an amount of 1.5%, and then dried by an appropriate drying method, so that a copy paper capable of being repeatedly used for image formation was obtained.

Toner images were formed on the above prepared copy paper using a commercially available plain paper copying machine (Trademark "IMAGIO 320 FP1" made by Ricoh Company, Ltd.).

The thus prepared toner image bearing copy paper was immersed into an aqueous solution of carboxymethyl cellulose in an amount of 1.5% and the commercially available bleaching agent "Heiter" (Trademark), made by Kao Corporation in an amount of 1.5%.

Then, the toner images were removed from the copy paper by the same method as in Example 1, so that a plain paper free from toner images thereon was obtained. The surface profile of the copy paper after the above-mentioned image peeling operation was similar to that of a fresh copy paper. There was never seen any residual dye image which was formed on the support material by the permeation of a small amount of the dye contained in the toner through the support material.

This copy paper was dried, and toner images were formed once again on the copy paper by use of the above-mentioned copying machine. The result was that clear toner images were formed on the copy paper exactly in the same state as first formed.

The above operation was repeated 10 times. Toner images with the same quality were formed on the copy paper throughout the above ten operations.

EXAMPLE 3

A fresh copy paper of A4 size for use with a plain paper copying machine was immersed into an aqueous solution of a water-soluble starch in an amount of 1% and sodium hydrosulfite serving as a bleaching agent in an amount of 2%, and then dried by an appropriate drying method, so that a copy paper capable of being repeatedly used for image formation was obtained.

Toner images were formed on both sides of the above prepared copy paper using a commercially available plain paper copying machine (Trademark "IMAGIO 320 FP1" made by Ricoh Company, Ltd.).

The thus prepared toner image bearing copy paper was immersed into an aqueous solution of a water-soluble starch in an amount of 1% and sodium hydrosulfite in an amount of 2%. Then, a heated rubber roller was brought into pressure contact with the toner image bearing sides of the copy paper one by one. When the rubber roller was released from the image-bearing copy paper, the toner images were thoroughly transferred to the rubber roller.

The copy paper which passed over the rubber roller became a plain paper free from toner images thereon. When the images were peeled from the copy paper by use of the rubber roller, the cellulose fibers have scarcely been removed from the paper layer of the copy paper. Therefore, the surface profile of the copy paper after the above-mentioned image peeling operation was similar to that of a fresh copy paper. There was never seen any residual dye image which was formed on the support material by the permeation of a small amount of the dye contained in the toner through the support material.

This copy paper was dried, and toner images were formed once again on both sides of the copy paper by use of the above-mentioned copying machine. The result was that clear toner images were formed on both sides of the copy paper exactly in the same state as first formed.

The above operation was repeated 10 times. Toner images with the same quality were formed on both sides of the copy paper throughout the above ten operations.

EXAMPLE 4

A fresh copy paper of A4 size for use with a plain paper copying machine was immersed into an aqueous solution of a commercially available surfactant "Tonerclean 205" (Trademark), made by Nippon Nyukazai Co., Ltd., in an amount of 1% and a commercially available chlorine-containing bleaching agent "Heiter" (Trademark), made by Kao Corporation in an amount of 2%, and then dried by an appropriate drying method, so that a copy paper capable of being repeatedly used for image formation was obtained.

Toner images were formed on the above prepared copy paper using a commercially available plain paper copying machine (Trademark "IMAGIO 320 FP1" made by Ricoh Company, Ltd.).

The thus prepared toner image bearing copy paper was immersed into an aqueous solution of a water-soluble starch in an amount of 1%, a commercially available surfactant "BT-9" (Trademark), made by Nikko Chemicals Co., Ltd., in an amount of 2% and the commercially available bleaching agent "Heiter" (Trademark), made by Kao Corporation in an amount of 2%.

Then, the toner images were removed from the copy paper by the same method as in Example 1, so that a plain paper free from toner images thereon was obtained. The surface profile of the copy paper after the above-mentioned image peeling operation was similar to that of a fresh copy paper. There was never seen any residual dye image which was formed on the support material by the permeation of a small amount of the dye contained in the toner through the support material.

This copy paper was dried, and toner images were formed once again on the copy paper by use of the above-mentioned copying machine. The result was that clear toner images were formed on the copy paper exactly in the same state as first formed.

The above operation was repeated 10 times. Toner images with the same quality were formed on the copy paper throughout the above ten operations.

EXAMPLE 5

A fresh copy paper of A4 size for use with a plain paper copying machine was treated by the same method as in Example 1, so that a copy paper capable of being repeatedly used for image formation was obtained.

Toner images were formed on the above prepared copy paper using a commercially available plain paper copying machine (Trademark "IMAGIO 320 FP1" made by Ricoh Company, Ltd.).

The thus prepared toner image bearing copy paper was immersed into a 1% aqueous solution of a water-soluble starch. Then, a heated rubber roller was brought into pressure contact with the toner image bearing side of the copy paper. When the rubber roller was released from the image-bearing copy paper, the toner images were thoroughly transferred to the rubber roller.

The copy paper which passed over the rubber roller became a plain paper free from toner images thereon. When the images were peeled from the copy paper by use of the rubber roller, the cellulose fibers have scarcely been removed from the paper layer of the copy paper. Therefore, the surface profile of the copy paper after the above-mentioned image peeling operation was similar to that of a fresh copy paper. There was never seen any residual dye image which was formed on the support material by the permeation of a small amount of the dye contained in the toner through the support material.

This copy paper was dried, and toner images were formed once again on the copy paper by use of the above-mentioned copying machine. The result was that clear toner images were formed on the copy paper exactly in the same state as first formed.

The above operation was repeated 5 times. Toner images with the same quality were formed on the copy paper throughout the above five operations.

EXAMPLE 6

A fresh copy paper of A4 size for use with a plain paper copying machine was treated by the same method as in Example 2, so that a copy paper capable of being repeatedly used for image formation was obtained.

Toner images were formed on the above prepared copy paper using a commercially available plain paper copying machine (Trademark "IMAGIO 320 FP1" made by Ricoh Company, Ltd.).

The thus prepared toner image bearing copy paper was immersed into a 1.5% aqueous solution of carboxymethyl cellulose. Then, the toner images were removed from the copy paper by the same method as in Example 1, so that a plain paper free from toner images thereon was obtained. The surface profile of the copy paper after the above-mentioned image peeling operation was similar to that of a fresh copy paper. There was never seen any residual dye image which was formed on the support material by the permeation of a small amount of the dye contained in the toner through the support material.

This copy paper was dried, and toner images were formed once again on the copy paper by use of the above-mentioned copying machine. The result was that clear toner images were formed on the copy paper exactly in the same state as first formed.

The above operation was repeated 5 times. Toner images with the same quality were formed on the copy paper throughout the above five operations.

EXAMPLE 7

A fresh copy paper of A4 size for use with a plain paper copying machine was treated by the same method as in Example 3, so that a copy paper capable of being repeatedly used for image formation was obtained.

Toner images were formed on both sides of the above prepared copy paper using a commercially available plain paper copying machine (Trademark "IMAGIO 320 FP1" made by Ricoh Company, Ltd.).

The thus prepared toner image bearing copy paper was immersed into a 1% aqueous solution of a water-soluble starch. Then, a heated rubber roller was brought into pressure contact with the toner image bearing sides of the copy paper one by one. When the rubber roller was released from the image-bearing copy paper, the toner images were thoroughly transferred to the rubber roller.

The copy paper which passed over the rubber roller became a plain paper free from toner images thereon. When the images were peeled from the copy paper by use of the rubber roller, the cellulose fibers have scarcely been removed from the paper layer of the copy paper. Therefore, the surface profile of the copy paper after the above-mentioned image peeling operation was similar to that of a fresh copy paper. There was never seen any residual dye image which was formed on the support material by the permeation of a small amount of the dye contained in the toner through the support material.

This copy paper was dried, and toner images were formed once again on both sides of the copy paper by use of the above-mentioned copying machine. The result was that clear toner images were formed on both sides of the copy paper exactly in the same state as first formed.

The above operation was repeated 5 times. Toner images with the same quality were formed on both sides of the copy paper throughout the above five operations.

EXAMPLE 8

A fresh copy paper of A4 size for use with a plain paper copying machine was treated by the same method as in Example 4, so that a copy paper capable of being repeatedly used for image formation was obtained.

Toner images were formed on the above prepared copy paper using a commercially available plain paper copying machine (Trademark "IMAGIO 320 FP1" made by Ricoh Company, Ltd.).

The thus prepared toner image bearing copy paper was immersed into an aqueous solution of a water-soluble starch in an amount of 1% and a commercially available surfactant "BT-9" (Trademark), made by Nikko Chemicals Co., Ltd., in an amount of 2%.

Then, the toner images were removed from the copy paper by the same method as in Example 1, so that a plain paper free from toner images thereon was obtained. The surface profile of the copy paper after the above-mentioned image peeling operation was similar to that of a fresh copy paper. There was never seen any residual dye image which was formed on the support material by the permeation of a small amount of the dye contained in the toner through the support material.

This copy paper was dried, and toner images were formed once again on the copy paper by use of the above-mentioned copying machine. The result was that clear toner images were formed on the copy paper exactly in the same state as first formed.

The above operation was repeated 5 times. Toner images with the same quality were formed on the copy paper throughout the above five operations.

EXAMPLE 9

A fresh copy paper of A4 size for use with a plain paper copying machine was immersed into a 1% aqueous solution of a water-soluble starch, and then dried by an appropriate drying method, so that a copy paper capable of being repeatedly used for image formation was obtained.

Toner images were formed on the above prepared copy paper and peeled therefrom by the same method as in Example 1.

The copy paper which passed over the rubber roller became a plain paper free from toner images thereon. When the images were peeled from the copy paper by use of the rubber roller, the cellulose fibers have scarcely been removed from the paper layer of the copy paper. Therefore, the surface profile of the copy paper after the above-mentioned image peeling operation was similar to that of a fresh copy paper. There was never seen any residual dye image which was formed on the support material by the permeation of a small amount of the dye contained in the toner through the support material.

This copy paper was dried, and toner images were formed once again on the copy paper by use of the above-mentioned copying machine. The result was that clear toner images were formed on the copy paper exactly in the same state as first formed.

The above operation was repeated 10 times. Toner images with the same quality were formed on the copy paper throughout the above ten operations.

EXAMPLE 10

A fresh copy paper of A4 size for use with a plain paper copying machine was immersed into a 2% aqueous solution of carboxymethyl cellulose, and then dried by an appropriate drying method, so that a copy paper capable of being repeatedly used for image formation was obtained.

Toner images were formed on the above prepared copy paper and peeled therefrom by the same method as in Example 2, so that a plain paper free from toner images thereon was obtained. The surface profile of the copy paper after the above-mentioned image peeling operation was similar to that of a fresh copy paper. There was never seen any residual dye image which was formed on the support material by the permeation of a small amount of the dye contained in the toner through the support material.

This copy paper was dried, and toner images were formed once again on the copy paper by use of the above-mentioned copying machine. The result was that clear toner images were formed on the copy paper exactly in the same state as first formed.

The above operation was epeated 10 times. Toner images with the same quality were formed on the copy paper throughout the above ten operations.

EXAMPLE 11

A fresh copy paper of A4 size for use with a plain paper copying machine was immersed into a 1% aqueous solution of a water-soluble starch, and then dried by an appropriate drying method, so that a copy paper capable of being repeatedly used for image formation was obtained.

Toner images were formed on both sides of the above prepared copy paper and peeled therefrom by the same method as in Example 3.

The copy paper which passed over the rubber roller became a plain paper free from toner images thereon. When the images were peeled from the copy paper by use of the rubber roller, the cellulose fibers have scarcely been removed from the paper layer of the copy paper. Therefore, the surface profile of the copy paper after the above-mentioned image peeling operation was similar to that of a fresh copy paper. There was never seen any residual dye image which was formed on the support material by the permeation of a small amount of the dye contained in the toner through the support material.

This copy paper was dried, and toner images were formed once again on both sides of the copy paper by use of the above-mentioned copying machine. The result was that clear toner images were formed on both sides of the copy paper exactly in the same state as first formed.

The above operation was repeated 10 times. Toner images with the same quality were formed on both sides of the copy paper throughout the above ten operations.

EXAMPLE 12

A fresh copy paper of A4 size for use with a plain paper copying machine was immersed into a 1% aqueous solution of a commercially available surfactant "Tonerclean 205" (Trademark), made by Nippon Nyukazai Co., Ltd, and then dried by an appropriate drying method, so that a copy paper capable of being repeatedly used for image formation was obtained.

Toner images were formed on the above prepared copy paper and peeled therefrom by the same method as in Example 4, so that a plain paper free from toner images thereon was obtained. The surface profile of the copy paper after the above-mentioned image peeling operation was similar to that of a fresh copy paper. There was never seen any residual dye image which was formed on the support material by the permeation of a small amount of the dye contained in the toner through the support material.

This copy paper was dried, and toner images were formed once again on the copy paper by use of the above-mentioned copying machine. The result was that clear toner images were formed on the copy paper exactly in the same state as first formed.

The above operation was repeated 10 times. Toner images with the same quality were formed on the copy paper throughout the above ten operations.

EXAMPLE 13

A fresh copy paper of A4 size for use with a plain paper copying machine was treated by the same method as in Example 12, so that a copy paper capable of being repeatedly used for image formation was obtained.

Toner images were formed on the above prepared copy paper using a commercially available plain paper copying machine (Trademark "IMAGIO 320 FP1" made by Ricoh Company, Ltd.).

The same toner image peeling operation as in Example 12 was repeated except that the aqueous solution of the water-soluble starch, the commercially available surfactant "BT-9" (Trademark), made by Nikko Chemicals Co., Ltd., and the commercially available bleaching agent "Heiter" (Trademark), made by Kao Corporation was replaced by an aqueous solution of carboxymethyl cellulose in an amount of 2%, a commercially available surfactant "BT-9" (Trademark), made by Nikko Chemicals Co., Ltd., in an amount of 2% and sodium peroxide in an amount of 2%.

As a result, there was never seen any residual dye image which was formed on the support material by the permeation of a small amount of the dye contained in the toner through the support material.

This copy paper was dried, and toner images were formed once again on the copy paper by use of the above-mentioned copying machine. The above operation was repeated 10 times. The surface profile of the copy paper after conducting the above operations was similar to that of a fresh copy paper, and the toner images with the same quality were formed on the copy paper throughout the above ten operations.

Comparative Example 1

Toner images were formed on a fresh copy paper of A4 size, using a commercially available plain paper copying machine (Trademark "IMAGIO 320 FP1" made by Ricoh Company, Ltd.).

The thus prepared toner image bearing copy paper was immersed into water.

The toner image bearing side of the copy paper was brought into pressure contact with a heated rubber roller. When the rubber roller was released from the image-bearing copy paper, the toner images were thoroughly transferred to the rubber roller.

The copy paper which passed over the rubber roller became a plain paper free from toner images thereon.

This copy paper was dried, and toner images were formed once again on the copy paper by use of the above-mentioned copying machine. The result was that clear toner images were formed on the copy paper exactly in the same state as first formed.

The above operation was repeated 10 times. Although the toner images with the same quality were formed on the copy paper throughout the above ten operations, there were seen some residual dye images which were formed on the support material by the permeation of a small amount of the dye contained in the toner through the support material.

EXAMPLE 14

The same toner image peeling operation as in Comparative Example 1 was repeated except that water employed in Comparative Example 1 was replaced by an aqueous solution of a commercially available surfactant "BT-12" (Trademark), made by Nikko Chemicals Co., Ltd. in an amount of 1%, and a commercially available bleaching agent "Heiter" (Trademark), made by Kao Corporation in an amount of 2%. Thus, a copy paper capable of being repeatedly used for image formation was obtained.

This copy paper was dried, and toner images were formed once again on the copy paper by use of the above-mentioned copying machine. The above operation was repeated 10 times. The toner images with the same quality were formed on the copy paper, and the surface profile of the copy paper was similar to that of a fresh copy paper throughout the above ten operations. In addition, there was never seen any residual dye image which was formed on the support material by the permeation of a small amount of the dye contained in the toner through the support material.

EXAMPLE 15

The same toner image peeling operation as in Comparative Example 1 was repeated except that water employed in Comparative Example 1 was replaced by an aqueous solution of a water-soluble starch in an amount of 2%, a commercially available surfactant "BT-12" (Trademark), made by Nikko Chemicals Co., Ltd. in an amount of 0.5%, and a commercially available bleaching agent "Color Bright" (Trademark), made by Lion Corporation in an amount of 2%. Thus, a copy paper capable of being repeatedly used for image formation was obtained.

This copy paper was dried, and toner images were formed once again on the copy paper by use of the above-mentioned copying machine. The above operation was repeated 10 times. The toner images with the same quality were formed on the copy paper, and the surface profile of the copy paper was similar to that of a fresh copy paper throughout the above ten operations. In addition, there was never seen any residual dye image which was formed on the support material by the permeation of a small amount of the dye contained in the toner through the support material.

EXAMPLE 16

The same toner image peeling operation as in Comparative Example 1 was repeated except that water employed in Comparative Example 1 was replaced by an aqueous solution of carboxymethyl cellulose in an amount of 2%, a commercially available surfactant "BT-9" (Trademark), made by Nikko Chemicals Co., Ltd., in an amount of 1%, and a commercially available bleaching agent "Heiter" (Trademark), made by Kao Corporation in an amount of 2%. Thus, a copy paper capable of being repeatedly used for image formation was obtained.

This copy paper was dried, and toner images were formed once again on the copy paper by use of the above-mentioned copying machine. The above operation was repeated 10 times. The toner images with the same quality were formed on the copy paper, and the surface profile of the copy paper was similar to that of a fresh copy paper throughout the above ten operations. In addition, there was never seen any residual dye image which was formed on the support material by the permeation of a small amount of the dye contained in the toner through the support material.

EXAMPLE 17

The same toner image peeling operation as in Comparative Example 1 was repeated except that water employed in Comparative Example 1 was replaced by an aqueous solution of a commercially available surfactant "Tonerclean 205" (Trademark), made by Nippon Nyukazai Co., Ltd., in an amount of 1.5%, a water-soluble starch in an amount of 3%, and sodium peroxide serving as a bleaching agent in an amount of 2%. Thus, a copy paper capable of being repeatedly used for image formation was obtained.

This copy paper was dried, and toner images were formed once again on the copy paper by use of the above-mentioned copying machine. The above operation was repeated 10 times. The toner images with the same quality were formed on the copy paper, and the surface profile of the copy paper was similar to that of a fresh copy paper throughout the above ten operations.

EXAMPLE 18

The same toner image peeling operation as in Comparative Example 1 was repeated except that water employed in Comparative Example 1 was replaced by an aqueous solution of a commercially available surfactant "Tonerclean 205" (Trademark), made by Nippon Nyukazai Co., Ltd., in an amount of 1.5%, a water-soluble carboxymethyl cellulose in an amount of 2%, and potassium hypochlorite serving as a bleaching agent in an amount of 1%. Thus, a copy paper capable of being repeatedly used for image formation was obtained.

This copy paper was dried, and toner images were formed once again on the copy paper by use of the above-mentioned copying machine. The above operation was repeated 10 times. The toner images with the same quality were formed on the copy paper, and the surface profile of the copy paper was similar to that of a fresh copy paper throughout the above ten operations. In addition, there was never seen any residual dye image which was formed on the support material by the permeation of a small amount of the dye contained in the toner through the support material.

EXAMPLE 19

Toner images were formed on a fresh copy paper of A4 size, using a commercially available plain paper copying machine (Trademark "IMAGIO 320 FP1" made by Ricoh Company, Ltd.).

The thus prepared toner image bearing copy paper was immersed into an aqueous solution of a commercially available surfactant "Tonerclean 205" (Trademark), made by Nippon Nyukazai Co., Ltd., in an amount of 1%, and sodium hydrosulfite serving as a bleaching agent in an amount of 5%.

The toner image bearing side of the copy paper was brought into pressure contact with the adhesive surface of cellophane tape. When the cellophane tape was released from the image-bearing copy paper, the toner images were thoroughly transferred to the cellophane tape. Thus, the copy paper became a plain paper free from toner images thereon.

This copy paper was dried, and toner images were formed once again on the copy paper by use of the above-mentioned copying machine. The result was that clear toner images were formed on the copy paper exactly in the same state as first formed.

The above operation was repeated 10 times. The toner images with the same quality were formed on the copy paper throughout the above ten operations, and there was never seen any residual dye image which was formed on the support material by the permeation of a small amount of the dye contained in the toner through the support material.

EXAMPLE 20

The same toner image peeling operation as in Comparative Example 1 was repeated except that water employed in Comparative Example 1 was replaced by an aqueous solution of a commercially available surfactant "Tonerclean 205" (Trademark), made by Nippon Nyukazai Co., Ltd., in an amount of 1.5%, a water-soluble carboxymethyl cellulose in an amount of 3%, and sodium peroxoborate serving as a bleaching agent in an amount of 2%. Thus, toner images formed on the copy paper were thoroughly transferred to the surface of the rubber roller.

The copy paper which passed over the rubber roller became a plain paper free from toner images thereon.

This copy paper was dried, and toner images were formed once again on the copy paper by use of the above-mentioned copying machine. The result was that clear toner images were formed on the copy paper exactly in the same state as first formed.

The above operation was repeated 10 times. The toner images with the same quality were formed on the copy paper throughout the above ten operations, and there was never seen any residual dye image which was formed on the support material by the permeation of a small amount of the dye contained in the toner through the support material.

EXAMPLE 21

Toner images were formed on a fresh copy paper of A4 size, using a commercially available plain paper copying machine (Trademark "IMAGIO 320 FP1" made by Ricoh Company, Ltd.).

The thus prepared toner image bearing copy paper was immersed into an aqueous solution of a commercially available surfactant "Tonerclean 205" (Trademark), made by Nippon Nyukazai Co., Ltd., in an amount of 1.5%, a water-soluble carboxymethyl cellulose in an amount of 3%, and a commercially available bleaching agent "Color Bright" (Trademark), made by Lion Corporation in an amount of 5%.

The toner image bearing side of the copy paper was brought into pressure contact with the adhesive surface of gummed tape. When the gummed tape was released from the image-bearing copy paper, the toner images were thoroughly transferred to the gummed tape. Thus, the copy paper became a plain paper free from toner images thereon.

This copy paper was dried, and toner images were formed once again on the copy paper by use of the above-mentioned copying machine. The result was that clear toner images were formed on the copy paper exactly in the same state as first formed.

The above operation was repeated 10 times. The toner images with the same quality were formed on the copy paper throughout the above ten operations, and there was never seen any residual dye image which was formed on the support material by the permeation of a small amount of the dye contained in the toner through the support material.

EXAMPLE 22

Toner images were formed on a fresh copy paper of A4 size, using a commercially available plain paper copying machine (Trademark "IMAGIO 320 FP1" made by Ricoh Company, Ltd.).

The thus prepared toner image bearing copy paper was immersed into an aqueous solution of a commercially available surfactant "Tonerclean 205" (Trademark), made by Nippon Nyukazai Co., Ltd., in an amount of 1.5%, a water-soluble carboxymethyl cellulose in an amount of 3%, and chloride of lime serving as a bleaching agent in an amount of 2%.

The toner image bearing side of the copy paper was brought into pressure contact with an image peeling-off sheet comprising a resin component for use in the thermofusible ink, which was composed of polystyrene, poly-n-butyl acrylate, and poly-i-butyl methacrylate with the ratios of 10:4:8 with the application of heat. When the image peeling-off sheet was released from the image-bearing copy paper, the toner images were thoroughly transferred to the image peeling-off sheet. Thus, the copy paper became a plain paper free from toner images thereon.

This copy paper was dried, and toner images were formed once again on the copy paper by use of the above-mentioned copying machine. The result was that clear toner images were formed on the copy paper exactly in the same state as first formed.

The above operation was repeated 10 times. The toner images with the same quality were formed on the copy paper throughout the above ten operations, and there was never seen any residual dye image which was formed on the support material by the permeation of a small amount of the dye contained in the toner through the support material.

As previously explained, when toner images are formed on the image-bearing member according to the present invention, at least part of which comprises a cellulose-fiber-containing paper layer, the toner images can completely be removed from the copy paper without impairing the paper layer and forming residual dye images caused by the permeation of a dye contained in the toner through the paper layer. Therefore, the image-bearing member of the present invention can repeatedly be used for image formation, thereby reducing the consumption of copy papers.

Japanese Patent Application No. 5-201886 filed on Jul. 22, 1993 is hereby incorporated by reference.

What is claimed is:

1. A method of recycling an image-bearing member comprising a support material, at least part of said support material comprising a paper layer which comprises cellulose fibers and bears an image formed by a thermofusible or heat-softening ink which comprises a dye coloring component, comprising the steps of:

bringing said image-bearing member and image into contact with an aqueous solution of a discoloring agent capable of discoloring said dye coloring component of said thermofusible or heat-softening ink; and peeling said image off said paper layer by an image peeling-off member which is adhesive to said image which has been contacted with said aqueous solution with the application of heat and/or pressure thereto.

2. The method of recycling an image-bearing member as claimed in claim 1, wherein said aqueous solution of said discoloring agent further comprises at least one component selected from the group consisting of a surfactant and a water-soluble polymer.

3. The method as claimed in claim 2, wherein said discoloring agent is selected from the group consisting of chloride of lime, sodium hypochlorite, potassium hypochlorite, sodium chlorite and potassium chlorite.

4. The method as claimed in claim 3, wherein said solution comprises a water-soluble polymer selected from the group consisting of cellulose and starch polymers.

5. The method as claimed in claim 2, wherein said solution comprises a water-soluble polymer selected from the group consisting of cellulose and starch polymers.

6. The method as claimed in claim 1, wherein said discoloring agent is selected from the group consisting of chloride of lime, sodium hypochlorite, potassium hypochlorite, sodium chlorite and potassium chlorite.

7. A method of recycling an image-bearing member comprising a support material, at least part of said support material comprising a paper layer which bears an image formed by a thermofusible or heat-softening ink comprising a dye coloring component, and comprises cellulose fibers and a discoloring agent capable of discoloring said dye coloring component of said thermofusible or heat-softening ink, comprising the steps of:

bringing said image-bearing member into contact with water, or an aqueous solution of at least one component selected from the group consisting of a surfactant, a water-soluble polymer, and said discoloring agent, and peeling said image off said paper layer by an image peeling-off member which is adhesive to said image which has been contacted with said water or aqueous solution with the application of heat and/or pressure thereto.

8. The method as claimed in claim 7, wherein said discoloring agent is selected from the group consisting of chloride of lime, sodium hypochlorite, potassium hypochlorite, sodium chlorite and potassium chlorite.

9. The method as claimed in claim 8, wherein said solution comprises a water-soluble polymer selected from the group consisting of cellulose and starch polymers.

10. The method as claimed in claim 7, wherein said solution comprises a water-soluble polymer selected from the group consisting of cellulose and starch polymers.

* * * * *